United States Patent [19]

Tolliver

[11] 4,270,583

[45] Jun. 2, 1981

[54] CONCRETE PIPE REINFORCEMENT SPACER BAR PROCESS

[76] Inventor: Wilbur E. Tolliver, 364 Hamilton Dr., Holland, Mich. 49423

[21] Appl. No.: 56,592

[22] Filed: Jul. 11, 1979

[51] Int. Cl.[3] ..... B21F 15/06; B21F 17/00

[52] U.S. Cl. ..... 140/92.1; 140/107; 140/111

[58] Field of Search ..... 140/92.1, 107, 111; 138/175, 148; 29/453

[56] References Cited

U.S. PATENT DOCUMENTS

| | | | |
|---|---|---|---|
| 3,440,792 | 4/1969 | Schmidgall | 138/175 X |
| 3,837,370 | 9/1974 | Gates et al. | 140/107 X |
| 3,840,054 | 10/1974 | Tolliver | 138/175 |
| 4,184,520 | 1/1980 | Tolliver | 138/175 X |

*Primary Examiner*—Richard B. Lazarus

*Attorney, Agent, or Firm*—Price, Heneveld, Huizenga & Cooper

[57] ABSTRACT

The specification discloses a method and related apparatus and cage assembly for spacing inner and outer concrete pipe reinforcing welded wire cages from one another through the use of a unique spacer bar. The spacer bar includes a plurality of links, each having a hook-shaped deviation therein, joined by a tie rod. The links are inserted through one of two cages until the tie rod abuts the cage and the hook deviations are then hooked over a longitudinal or circumferential wire or both in the other cage. Each link also includes at least one form spacer projection projecting from one end thereof in order to space the entire inner and outer cage assembly from the inner and/or outer wall of a pipe form.

44 Claims, 14 Drawing Figures

CONCRETE PIPE REINFORCEMENT SPACER BAR PROCESS

BACKGROUND OF THE INVENTION

The present invention relates to reinforcing concrete products. It is particularly applicable in reinforcing concrete pipe.

Concrete pipe is typically reinforced with welded wire fabric which is formed into a cylindrical configuration commonly referred to as "cage." The fabric itself comprises a first set of wire strands oriented generally parallel to one another and welded to a second set of generally parallel strands which are oriented transversely to the first set strands. In producing concrete pipe, such fabric is first formed into a generally cylindrical cage which is then inserted into a pipe making form.

Often, particularly in the case of larger pipe, the concrete pipe is reinforced with two cages, an inner cage and an outer cage. Special spacers comprising individual linking rods with some sort of hook at each end are provided to hold the two cages in spaced relationship with one another. Still other individual spacers have to be secured to at least the outer cage at various points to space the outer cage from the inner surface of the outside form wall which serves as a form for the concrete pipe. Where the pipe is formed by casting, both inner and outer pipe forms are provided and, often, the producer places special spacers on both the inside cage and the outside cage to space both cages from their adjacent inner and outer forms respectively.

Preparing a cage assembly in this way is a labor intensive operation. However, it is a job which has to be done and is one which has been done in the above manner for well over 25 years.

SUMMARY OF THE INVENTION

In the present invention, a spacer bar is provided for spacing inner and outer pipe reinforcing cages from one another and, in a narrower aspect of the invention, for spacing the assembled inner and outer cages from one or both of the pipe form walls. Each spacer bar comprises a plurality of links, each with a hook deviation therein, joined to a tie rod at a point spaced from the hook whereby one can insert the links through one cage until the tie rod engages the cage, and then hook the hooks over the strands in the other cage to hold the two cages together in spaced relationship.

These and other objects, advantages and features of the invention will be more fully understood and appreciated by reference to the written specification and appended drawings.

DESCRIPTION OF THE PREFERRED EMBODIMENT

Figure 1:
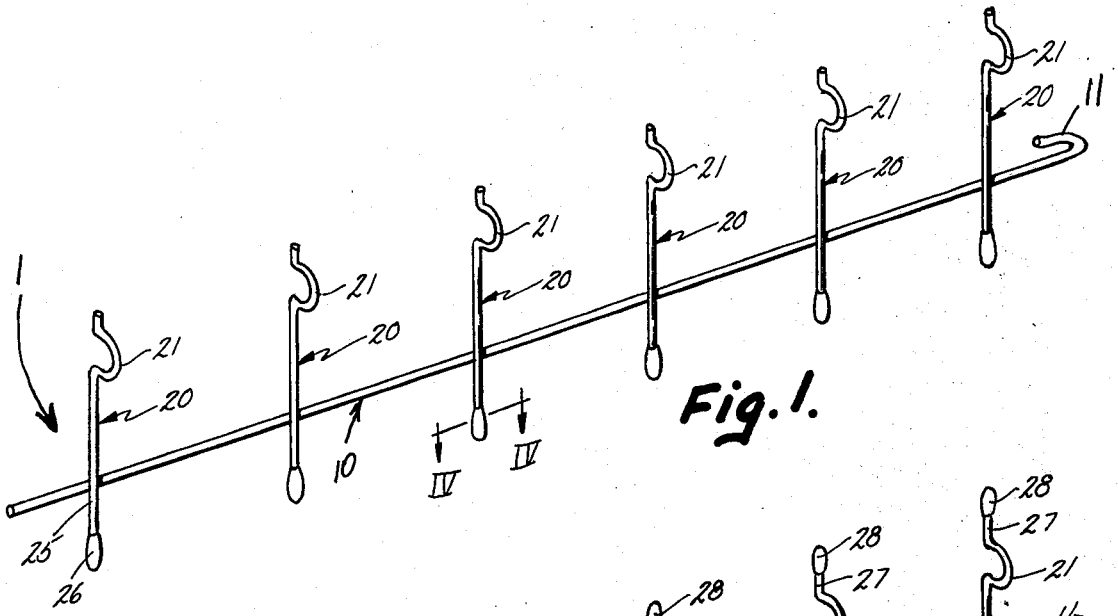
FIG. 1 is a perspective view of a spacer bar made in accordance with the present invention.
Figure 4:
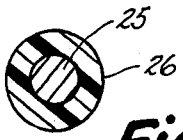
FIG. 4 is a cross-sectional view taken along plane IV—IV of FIG. 1.
Figure 2:
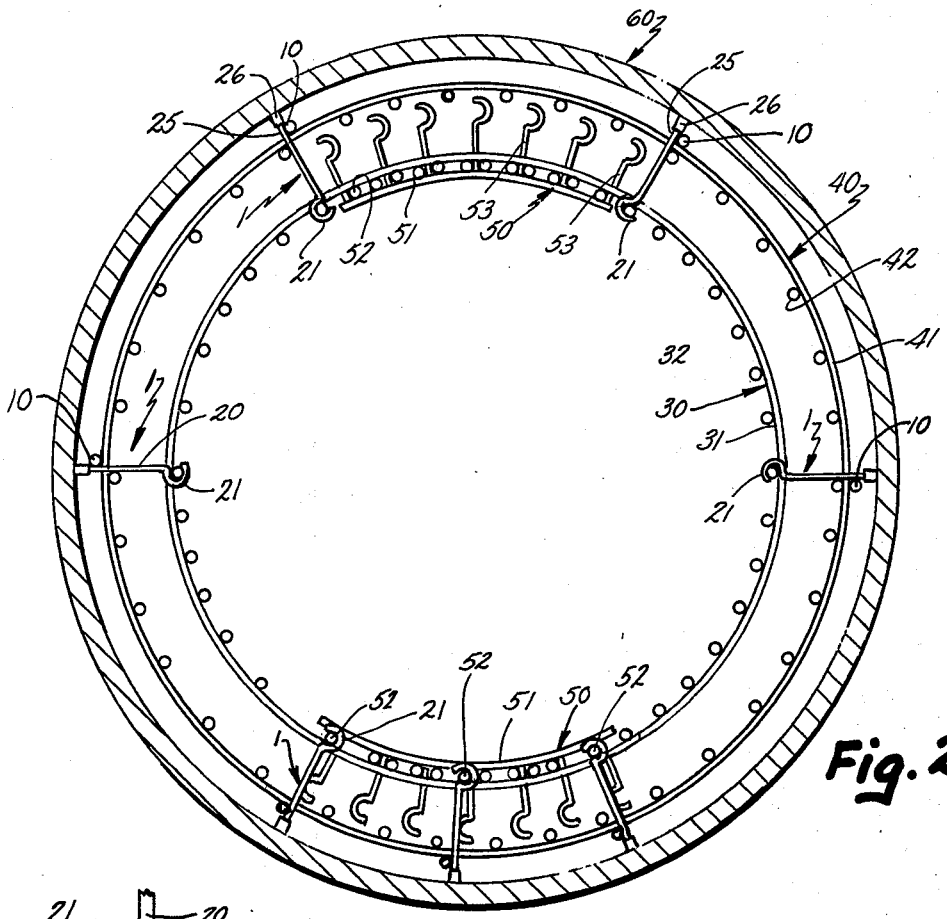
FIG. 2 is a lateral, cross-sectional view of an inner and outer cage assembly joined together and located in a concrete pipe form by means of spacer bars made in accordance with FIG. 1.

The spacer bar 1 of the present invention comprises a plurality of links 20 having hooked deviations 21 (FIG. 1). Links 20 are joined to a tie rod 10 which is spaced from hook deviations 21 a distance equal to the desired spacing between inner and outer pipe reinforcing cages 30 and 40 (FIG. 2). Each link 20 includes a form spacer projection 25 which projects beyond tie rod 10 a distance approximately equal to the desired spacing between the outer cage 40 and the inner surface of the form 60 which defines the outer configuration of the pipe. Each form spacer projection 25 is tipped with a plastic cap 26 (see FIG. 4 as well). This helps prevent the end of form spacer projection 25 from rusting with resultant rust leaking onto and staining the surface of a pipe.

Tie rod 10 is made of a length of relatively stiff wire rod. It is fairly safe to say that most types of wire reinforcing rods now used in reinforcing concrete pipe would be acceptable for wire rod 10. One preferably is able to bend wire rod 10 during manufacture of spacer bar 1 so as to form a tail hook 11 at one end thereof for hooking over a circumferential strand in one of the cages 30 or 40 being joined together. I specifically prefer a wire size of W 2.0 to W 6.0 in most applications.

Similarly, links 20 are each made of a length of relatively stiff concrete reinforcing wire rod. It is believed that most of the various types of wire reinforcement now used in reinforcing concrete pipe provide suitable raw material for links 20. They too must be bendable such that hooks 21 can be formed therein. I specifically prefer to use a wire size of W 4.0 to W 10.0 in most applications.

Tie rod is sufficiently long that several links 20 can be secured thereto at spaced points along its length. Preferably, tie rod 10 is at least about half as long as the reinforcing cage assembly 30 and 40 and most preferably about as long. Thus, typically, each tie rod 10 will be about 8 feet long, the length of a typical pipe section.

For a pipe length tie rod 10, there should be from 3 to 6 links 20 secured thereto at approximately equally spaced points along its length. For smaller length tie rods, the number of links would be proportionately smaller.

Figure 5:
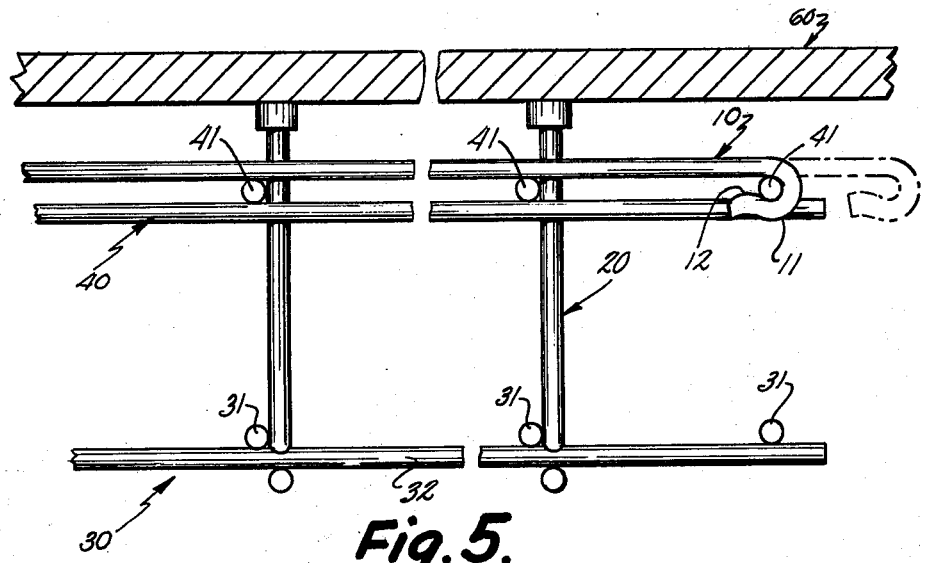
FIG. 5 is a fragmentary, longitudinal, cross-sectional view showing the manner in which the end of the spacer bar hooks over a circumferential wire strand in one of the pipe reinforcing cages.

In operation, one orients spacer bar 1 so that it is extending generally longitudinally of inner and outer cages 30 and 40. Cages 30 and 40 are conventional welded wire cages having a plurality of longitudinal strands 32 and 42, respectively, extending lengthwise of the cage and a plurality of circumferential strands 31 and 41, respectively, which extend circumferentially around the cage. The hooks 21 of links 20 are inserted through outer cage 40 from the outside thereof so that they project towards inner cage 30. When tie rod 10 comes to rest against the circumferential strands 41 of outer cage 40, one shifts spacer bar 1 longitudinally so that its tail hook 11 hooks over a circumferential strand 41 in outer cage 40 (FIG. 5). Tail hook 11 is spaced from the first link 20 a distance which is approximately equal to or just less than the distance between adjacent circumferential wires 41 so that as link 11 is snapped into position, the links 20 will be located adjacent the other circumferential strands 41.

Figure 3:
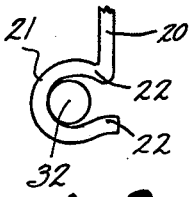
FIG. 3 is a fragmentary, enlarged showing of the manner in which the spacer bar linking member hooks over a longitudinal wire strand in one of the pipe reinforcing cages.

One then moves spacer bar 1 so that hooks 21 are moved towards the adjacent longitudinal strand 32 of inner cage 30. One forces hooks 21 over longitudinal strand 32 until they snap in place (FIG. 3).

In this regard, the distance across the opening of each hook 21 is slightly narrower than the diameter of longitudinal strand 32 so that each hook 21 snaps into position. Similarly, each hook deviation 21 is formed in such a way that there is a rounded, cam surface 22 at the opening of hook 21, preferably on both sides of the opening as shown in FIG. 3. However, it is possible that one side of the opening could be relatively straight and flat and the other have a cam surface 22. In a similar way, each tail hook 11 is narrower at its opening than the diameter of the circumferential wire 41 over which it is to be snapped (FIG. 5). The end of each tail hook 11 is bent in such a way that it also defines a curved, cammed surface 12, thereby enabling tail hook 11 to slide more easily over the circumferential strand 41.

The assembled inner and outer cages 30 and 40 can then be placed into a pipe form such as form 60 with the plastic tips 26 engaging form 60 and spacing the assembled inner and outer cages 30 and 40 from the inner surface of form 60.

The three spacer bars 1 located at the bottom of the inner and outer cage assembly shown in FIG. 2 are used to serve an additional function beyond that of the four spacer bars 1 shown in the upper half of the inner and outer cage assembly of FIG. 2. The FIG. 2 assembly includes a stirrup reinforcing mat 50 located at both the crown or upper portion of the cage assembly and at the invert or lower portion thereof. However an important difference is that the upper stirrup mat 50 is joined to inner cage 30 in a conventional manner while the lower stirrup mat 50 is joined to cage 30 by means of spacer bars 1. Indeed, the hook portions 21 of the bottom spacer bars 1 do not hook over the longitudinals 32 of inner cage 30. Rather, they hook over the longitudinals 52 which extend the length of stirrup reinforcing mat 50.

Stirrup reinforcing mat 50 includes transverse tie wires 51 which join longitudinals 52 together to form a mat, while stirrup projections 53 are joined to mat longitudinals 52 and project out of the plane of the mat towards outer cage 40. Because mat 50 is positioned on the inside of inner cage 30, one simultaneously secures stirrup mat 50 in place and properly secures and spaces inner cage 30 from outer cage 40 by hooking hook 21 over the longitudinals 52 of stirrup mat 50. This is, of course, in addition to serving the function of spacing the entire assembly of inner cage 30, outer cage 40 and stirrup mat 50 from form 60 by means of spacer projection 25. This same system could be used at the crown of the assembly shown in FIG. 2, but was not so shown for purposes of illustrating the difference in the two variations of the method of the present invention.

Using spacer bars 1 to secure the stirrup mats is particularly useful in conjunction with my manually formable stirrup mat which I disclose and claim in my prior copending U.S. patent application Ser. No. 858,103 filed Dec. 7, 1977 and entitled MANUALLY FORMABLE STIRRUP MAT REINFORCEMENT AND PIPE REINFORCING METHOD BASE THEREON. Manually formable stirrup mats can be manually shaped into an arcuate configuration corresponding to the circumference of the inner cage 30. By utilizing spacer bar 1 to hook over a centrally located mat longitudinal 52 and utilizing spacer bars 1 towards either side of a manually formable mat 50, one can hold the manually formable stirrup mat 50 in its arcuate configuration tightly against the interior of cage 30.

Two or three spacer bars 1 should be located at each of the crown and invert reinforcing areas of the cage assembly. Three are preferable where one is tying in a stirrup reinforcing mat 50 as well as tying the two cages 30 and 40 together. At least one spacer bar 1 should be located generally at each of the spring line reinforcing areas of the cage assembly, i.e. at the sides thereof as shown in FIG. 2, to help insure that the inner and outer cages 30 and 40 maintain their proper cylindrical configuration, whether that be circular or somewhat elliptical.

Figure 6:
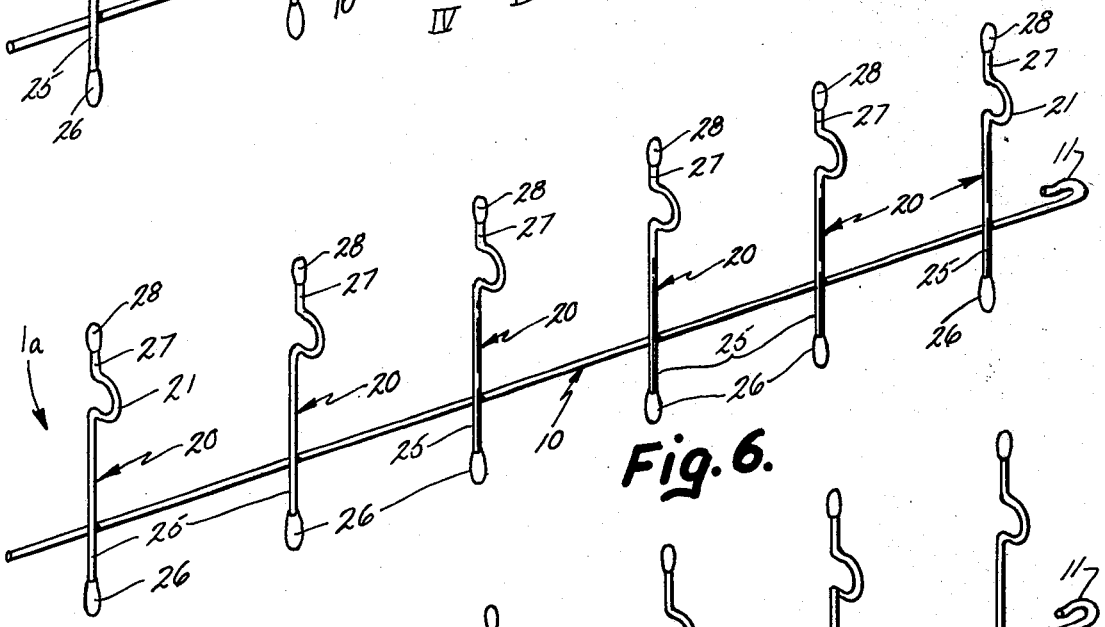
FIG. 6 is a perspective view of an alternative embodiment spacer bar.
Figure 7:
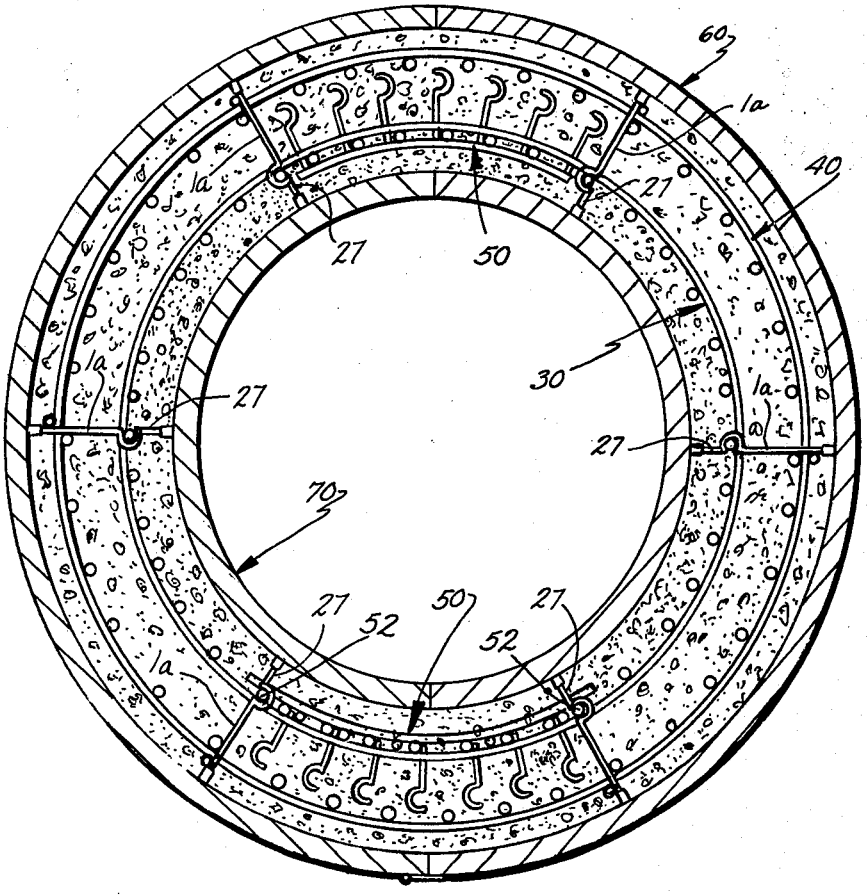
FIG. 7 is a lateral, cross-sectional view showing inner and outer cages joined together and located within inner and outer pipe forms by means of the alternative embodiment spacer bars of FIG. 6.

FIG. 6 discloses an alternative embodiment spacer bar **1*a* which is identical in every respect to spacer bar 1 except that it includes an additional form spacer projection 27, this one located at the upper terminal end of hook 21. Form spacer projection 27 projects upwardly from the end of hook 21 a distance approximately equal to the desired spacing between inner cage 30 and an adjacent inner form 70 (FIG. 7). Like spacer projection 25 at the opposite end of link 20, spacer projection 27 is tipped with a plastic tip 28 which is identical to plastic tip 26. The difference between the form arrangement in FIGS. 2 and 7 is that the FIG. 2 arrangement is designed to form pipe in a "packer head" type of machine where only an outer form 60** is provided. The rollers of the "packer head" machine form the interior surface of the pipe.

In contrast, the FIG. 7 arrangement is for casting concrete pipe wherein both an inside form 70 as well as an outside form 60 are provided. Except for the fact that spacers **1*a* enable one to space the combined inner and outer cage assembly 30 and 40 from both inner form 70 and outer form 60, spacer bar 1*a* is in all other respects identical to spacer bar 1** and can be used in precisely the same ways.

Figure 8:
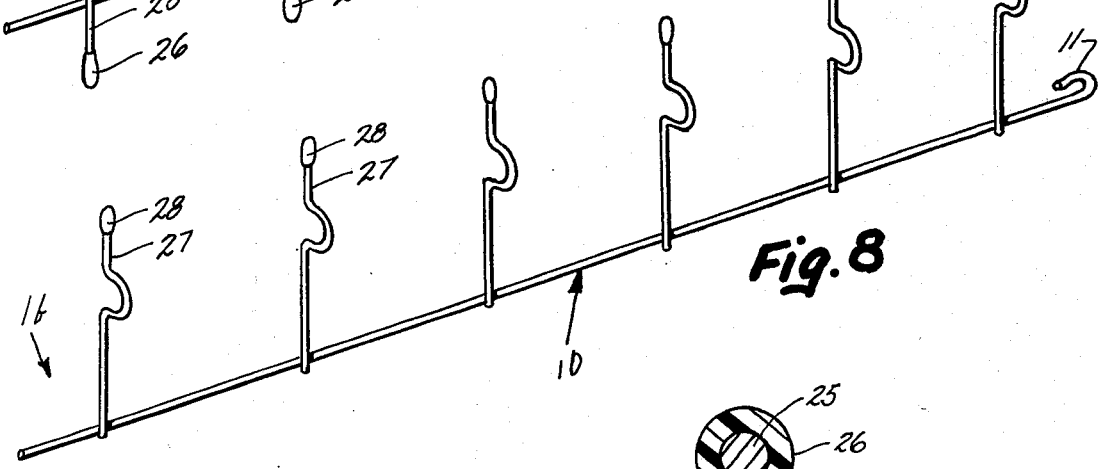
FIG. 8 is a perspective view of a second alternative embodiment spacer bar made in accordance with the present invention.

FIG. 8 discloses yet another alternative embodiment spacer bar 1*b* which is identical to embodiment 1*a* except that it eliminates the bottom form spacer projection 25 and its tip 26. That is because spacer bar 1*b* is designed for use in a packer head arrangement, but is designed to be inserted through inner cage 30 so that hooks 21 hook over the longitudinal 42 in outer cage 40 (compare FIGS. 9 and 2). The tip 28 of form spacer projection 27 then engages form 60 to properly space the assembled inner and outer cages 30 and 40. In all other respects, the uses of alternative embodiment spacer bar 1*b* are identical to the uses of spacer bar 1, and similarly of spacer bar 1*a*.

Figure 9:
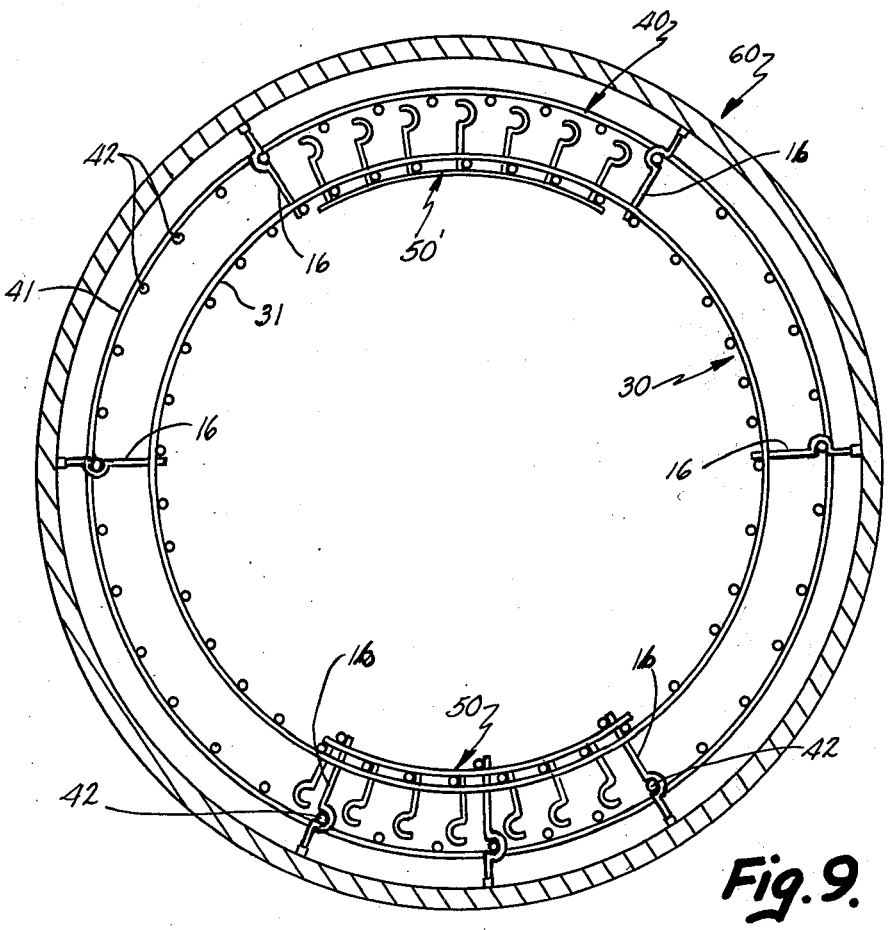
FIG. 9 is a lateral, cross-sectional view of inner and outer pipe reinforcing cages joined together and located within a pipe form using spacer bars made according to FIG. 8 alternative embodiment.

In a manner similar to FIG. 2, the stirrup mat 50 at the crown of the cage assembly shown in FIG. 9 is secured in position in a conventional manner while the mat 50 at the invert of the cage assembly is secured in place through the use of spacer bars 1*b*. The situation is somewhat reversed from the manner in which spacer bars 1 are used to secure mat 50 in place at the invert of the assembly in FIG. 2. Specifically, links 20 in spacer bars 1*b* are inserted through mat 50 and through inner cage 30 until tie rod 10 comes to rest against the surface of stirrup mat 50. Each spacer bar 1*b* is then moved until its hook 21 hooks over a longitudinal 42 and outer cage 40.

Figure 10:
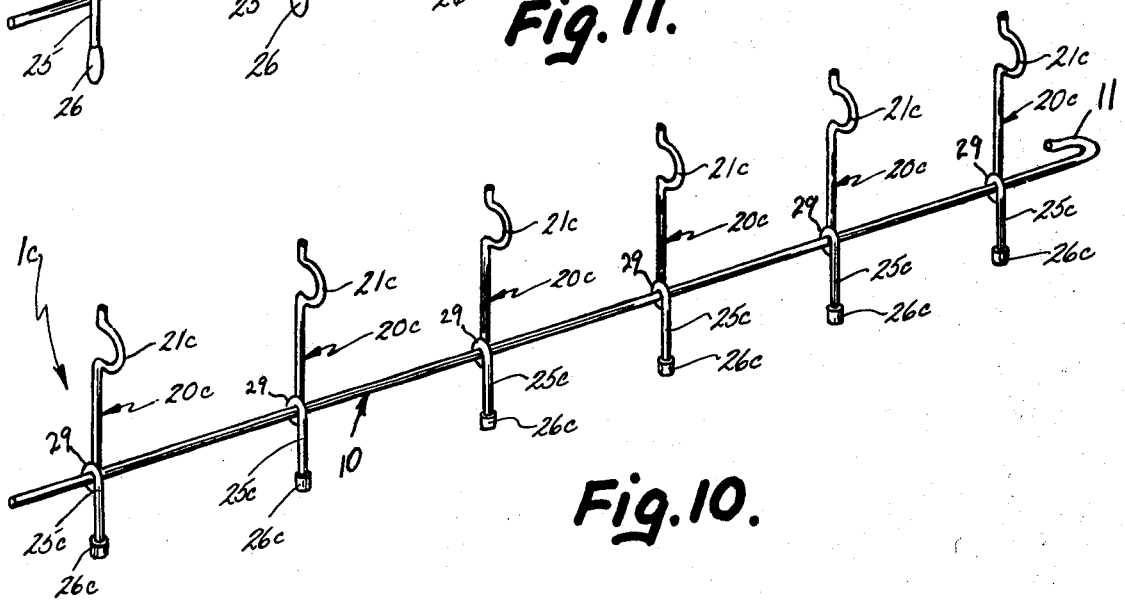
FIG. 10 is a perspective view of an alternative embodiment spacer bar wherein the individual links are slidably mounted on the bar.

The alternative embodiment spacer bar 1*c* shown in FIG. 10 is like spacer bar 1 of FIG. 1, except that each of the links 20*c* is slidable along the length of tie rod 10. This is accomplished in the preferred embodiment by simply wrapping a portion of link 20 around rod 10 to define a loop 29. As a result of this variation, links 20*c* can be slid along the length of tie rod 10 and hooked at any desired point along the length of the cage to which they are hooked. This variation would be particularly useful if the hook portions 21*c* of links 20*c* were oriented 90° from the orientation as shown, i.e. in the same plane as tie rod 10. In such a variation, each of the hooks 21*c* would be hooked over a circumferential wire of a cage rather than over a longitudinal wire. By being able to move the links 20*c* along the length of tie rod 10, one does not have to worry about the spacing between adjacent circumferential wires in the cage. By stocking a plurality of alternative embodiment spacer bars 1*c*, one could use them in a variety of different types of cages having different circumferential wire spacing.

Figure 11:
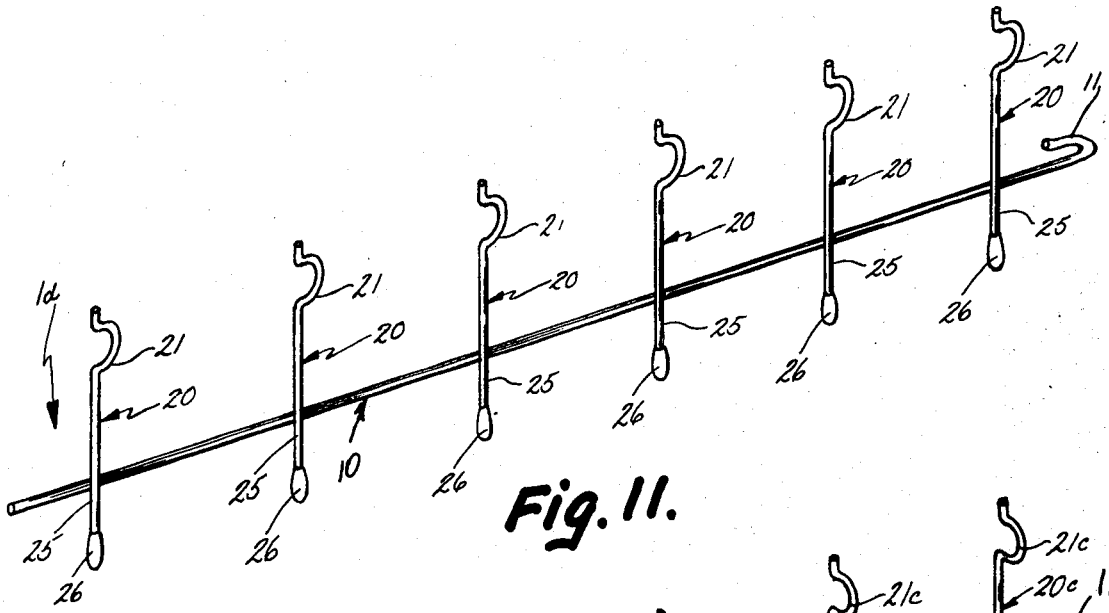
FIG. 11 is a perspective view of yet another alternative embodiment spacer bar wherein the hook-shaped deviations hook over circumferential wires instead of longitudinal wires.

The FIG. 11 alternative embodiment spacer bar 1*d* illustrates the variation of orienting the hook portions 21*d* so that they will hook over the circumferetial wires of the cage rather than the longitudinal wires. In all other respects, alternative embodiment 1*d* is identical to embodiment 1 shown in FIG. 1.

Figure 12:
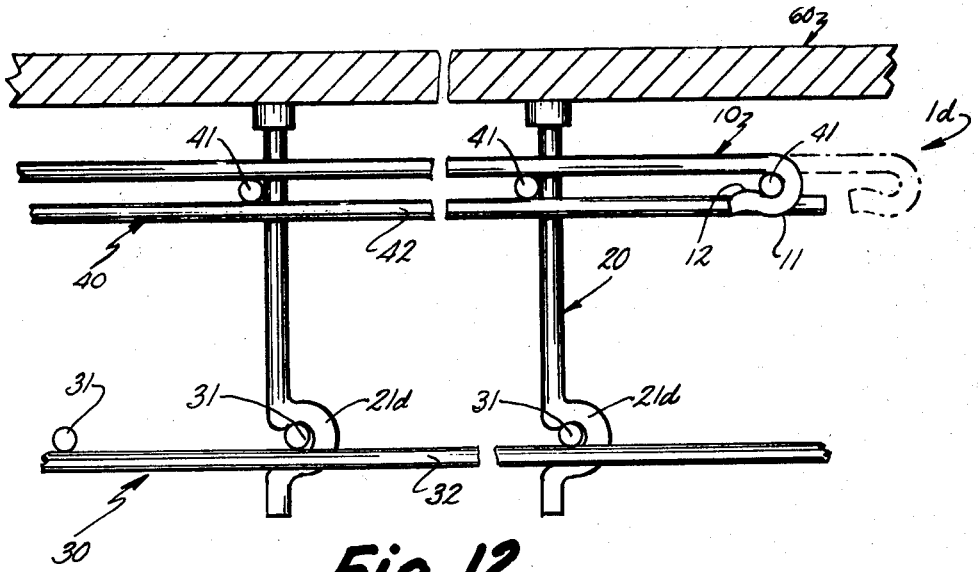
FIG. 12 is a fragmentary, longitudinal, cross-sectional view showing the manner in which the hooks hook over circumferential wires instead of longitudinal wires.

FIG. 12 shows a portion of spacer bar 1*d* in use. It can be seen that the hook portions 21*d* are hooking over the circumferential wires 31 in the cage rather than over the longitudinal wire 32 as is illustrated in FIG. 5.

Figure 14:
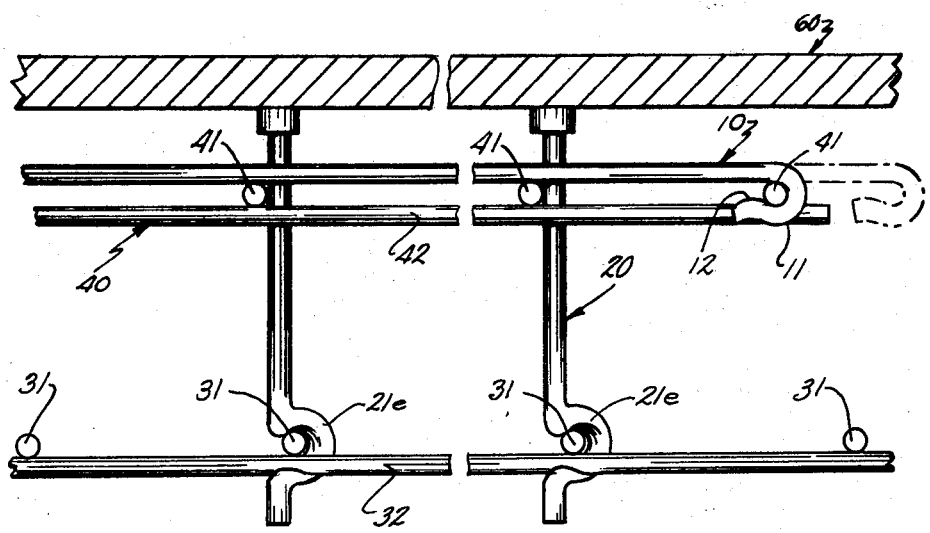
FIG. 14 is another fragmentary, longitudinal, cross-sectional view showing the manner in which the hooks of the FIG. 13 spacer bar hook over both a circumferential wire and a longitudinal wire in a pipe reinforcing cage.
Figure 13:
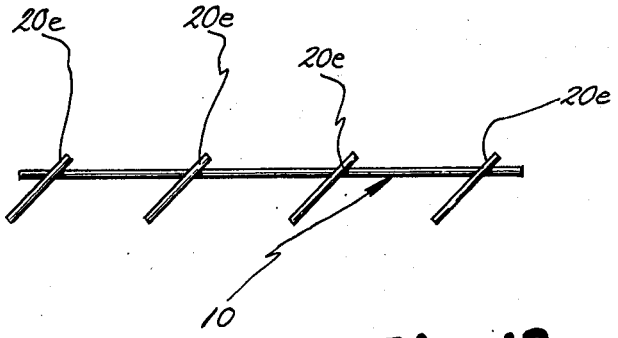
FIG. 13 is a top plan view of yet another alternative embodiment spacer bar.

FIG. 13 discloses yet another alternative embodiment spacer bar 1*e* wherein the links 20*e* are oriented at a 45° angle with respect to tie wire 10. They are designed for hooking over both a circumferential wire 31 and a longitudinal wire 32. Such an arrangement is illustrated in FIG. 14. In this regard, it will be noted that each of the hook deviations 21*e* have to be approximately twice as wide from top to bottom as the hook deviation 21 in the other embodiments illustrated in order to accommodate the thickness of both a circumferential wire 31 and a longitudinal wire 32.

Of course, various combinations of features disclosed above can be created which are not specifically shown above. It is understood that the spacer bars, methods of using same and the resulting assembly of inner and outer cages and stirrup mats are merely preferred embodiments and that various changes and alterations can be made without departing from the spirit and broader aspects of the invention as set forth in the appended claims, interpreted in light of the prior art and in accordance with the doctrine of equivalents.

The embodiments of the invention in which an exclusive property or privilege is claimed are defined as follows:

1. A method for assembling inner and outer generally cylindrical pipe reinforcing cages, each cage including a plurality of longitudinal wire strands joined to a plurality of circumferential wire strands, said method comprising: providing a spacer bar having a tie rod and a plurality of links joined to and spaced along the length of said tie rod, said links being generally parallel to one another and each including a hook spaced from said tie rod a distance approximately equal to the desired spacing between said inner and outer cages; inserting said links through one of said cages until said tie rod engages said one cage and then hooking said hooks over one or more wire strands in the other cage to thereby hold the two cages together.

2. The method of claim 1 wherein at least some of said links on each said spacer bar are provided with a form spacer projection projecting from either said hook or said tie rod, said form spacer projection having a length approximately equal to the desired spacing between one of said inner and outer cages and an adjacent form, said method further including the step of locating the assembled inner and outer cages within a pipe form with said form spacer projections engaging said form.

3. The method of claim 2 which includes providing said tie rod with a tail hook at one end thereof, said method including the step of sliding said spacer bar longitudinally after said links have been inserted through said one cage until said tail hook hooks over a circumferential wire of said one cage.

4. The method of either claim 2 or 3 wherein at least some of said links include two of said form spacer projections, one projecting beyond said tie rod and the other projecting from and beyond the terminal end of said hook, said method further including the step of locating said inner and outer cages within inner and outer pipe forms with said spacer projections at one end of said link engaging said inner form and said spacer projections at the other end of said links engaging said outer form.

5. The method of claim 4 which includes placing a plastic tip on the end of each said form spacer projection.

6. The method of claim 5 which includes slidably connecting said links to said tie rod whereby said links can be slid along the length of said tie rod until located at a point appropriate for hooking said hook of each over one of said wires in said other cage.

7. The method of claim 2 which includes placing a plastic tip on the end of each said form spacer projection.

8. The method of claim 1, 2 or 3 which includes hooking said hooks of said links in each of said spacer bars over a longitudinal strand of said other cage.

9. The method of claim 8 which includes slidably connecting said links to said tie rod whereby said links can be slid along the length of said tie rod until located at a point appropriate for hooking said hook of each over one of said wires in said other cage.

10. The method of claim 1, 2 or 3 which includes hooking said hooks of said links in each of said spacer bars over a circumferential strand of said other cage.

11. The method of claim 10 which includes slidably connecting said links to said tie rod whereby said links can be slid along the length of said tie rod until located at a point appropriate for hooking said hook of each over one of said wires in said other cage.

12. The method of claim 1, 2 or 3 which includes hooking said hooks of said links in each of said spacer bars over both a longitudinal strand and a circumferential strand of said other cage at the point at which said longitudinal and circumferential strands overlap.

13. The method of claim 12 which includes slidably connecting said links to said tie rod whereby said links can be slid along the length of said tie rod until located at a point appropriate for hooking said hook of each over one of said wires in said other cage.

14. The method of claim 1 which includes making each said hook narrower at its entrance than the wire strand which it hooks over whereby a snap fit is achieved between said hook and said wire strand.

15. The method of claim 14 in which said entrance of said hook is provided with at least one rounded cam surface whereby said wire strand snaps easily into said hook.

16. The method of claim 15 wherein said entrance to said hook is provided with two of said rounded cam surfaces, one on either side of said entrance to said hook.

17. The method of claim 3 in which said tail hook is provided with an entrance narrower than the circumferential strand which it hooks over whereby a snap fit therebetween is effected.

18. The method of claim 1, 2 or 3 which includes slidably connecting said links to said tie rod whereby said links can be slid along the length of said tie rod until located at a point appropriate for hooking said hook of each over one of said wires in said other cage.

19. A method for assembling inner and outer generally cylindrical pipe reinforcing cages, each cage including a plurality of longitudinal wire strands joined to a plurality of circumferential wire strands, said method comprising: providing a spacer bar having a tie rod and a plurality of links joined to and spaced along the length of said tie rod, said links being generally parallel to one another and each including a hook spaced from said tie rod a distance approximately equal to the desired spacing between said inner and outer cages; inserting said links through one of said cages until said tie rod engages said one cage; providing said tie rod with a tail hook at one end thereof, and sliding said spacer bar longitudinally after said links have been inserted through said one cage until said tail hook hooks over a circumferential wire of said one cage; moving said spacer bar such that said hooks of said links hook over a wire strand of the other of said cages to thereby hold the two cages together; and making each said hook narrower at its entrance than the wire strand which it hooks over whereby a snap fit is achieved between said hook and said wire strand; providing at least some of said links on each said spacer bar with a form spacer projection projecting from either said hook or said tie rod, said form spacer projection having a length approximately equal to the desired spacing between one of said inner and outer cages and an adjacent form, said method further including the step of locating the assembled inner and outer cages within a pipe form with said form spacer projections engaging said form.

20. The method of claim 19 which includes placing a plastic tip on the end of each said form spacer projection.

21. The method of claim 20 in which said entrance of said hook is provided with at least one rounded cam surface whereby said wire strand snaps easily into said hook.

22. The method of claim 21 wherein said entrance to said hook is provided with two of said rounded cam surfaces, one on either side of said entrance to said hook.

23. The method of claim 22 in which said tail hook is provided with an entrance narrower than the circumferential strand which it hooks over whereby a snap fit therebetween is effected.

24. The method of claim 19 in which said entrance of said hook is provided with at least one rounded cam surface whereby said wire strand snaps easily into said hook.

25. The method of claim 19, 20, 21, 22, 23 or 24 which includes slidably connecting said links to said tie rod whereby said links can be slid along the length of said tie rod until located at a point appropriate for hooking said hook of each over one of said wires in said other cage.

26. A method for assembling inner and outer generally cylindrical pipe reinforcing cages and for assembling a stirrup reinforcing mat thereto, each said cage including a plurality of longitudinal wire strands joined to a plurality of circumferential wire strands, and each said mat including a plurality of generally arcuate circumferentially oriented strands joined to a plurality of longitudinal strands with a plurality of stirrup projections projecting out of the plane of said mat and into the space between said inner and outer generally cylindrical pipe reinforcing cages, said method comprising: providing a spacer bar having a tie rod and a plurality of links joined to and spaced along the length of said tie rod, said links being generally parallel to one another and each including a hook spaced from said tie rod a distance approximately equal to the desired spacing between inner and outer cages; placing said mat in one of said cages with said mat surface engaging said cage and said stirrup projections projecting through said one cage towards the other cage; inserting the links of at least some of said spacer bars either through said mat and extending towards said other cage until said tie rod comes to rest against said mat, followed by hooking said hooks over one or more of said wire strands in said other cage, or inserting said links through said other cage until said tie rod comes to rest against said other cage, followed by hooking said hooks over one or more of said wire strands in said stirrup mat.

27. The method of claim 26 wherein at least some of said links on each said spacer bar are provided with a form spacer projection projecting from either said hook or said tie rod, said form spacer projection having a length approximately equal to the desired spacing between one of said inner and outer cages and an adjacent form, said method further including the step of locating the assembled inner and outer cages within a pipe form with said form spacer projections engaging said form.

28. The method of claim 27 which includes providing said tie rod with a tail hook at one end thereof, said method including: the step of sliding said spacer bar longitudinally after said links have been inserted into one or the other of cages until said tail hook hooks over a circumferential wire of its said one of said cages.

29. The method of either claim 27 or 28 wherein at least some of said links include two of said form spacer projections, one projecting beyond said tie rod and the other projecting from and beyond the terminal end of said hook, said method further including the step of locating said inner and outer cages within inner and outer pipe forms with said spacer projections at one end of said link engaging said inner form and said spacer projections at the other end of said links engaging said outer form.

30. The method of claim 29 which includes placing a plastic tip on the end of each said form spacer projection.

31. The method of claim 30 which includes slidably joining each of said links to said tie rod whereby said link can be slid along the length of said tie rod until properly located for hooking over a longitudinal strand of either said cage or said stirrup mat, respectively.

32. The method of claim 27 which includes placing a plastic tip on the end of each said form spacer projection.

33. The method of claim 26, 27, or 28 which includes hooking said hooks of said links in each of said spacer bars over a longitudinal strand of either said cage or said stirrup mat, respectively.

34. The method of claim 33 which includes slidably joining each of said links to said tie rod whereby said links can be slid along the length of said tie rod until properly located for hooking over a longitudinal strand of either said cage or said stirrup mat, respectively.

35. The method of claim 26, 27 or 28 which includes hooking said hooks of said links in each of said spacer bars over a circumferential strand of either said cage or said stirrup mat, respectively.

36. The method of claim 35 which includes slidably joining each of said links to said tie rod whereby said links can be slid along the length of said tie rod until properly located for hooking over a longitudinal strand of either said cage or said stirrup mat, respectively.

37. The method of claim 26, 27 or 28 which includes hooking said hooks of said links in each of said spacer bars over both a longitudinal strand and a circumferential strand of either said cage or said stirrup mat, respectively, at the point at which they overlap.

38. The method of claim 37 which includes slidably joining each of said links to said tie rod whereby said links can be slid along the length of said tie rod until properly located for hooking over a longitudinal strand of either said cage or said stirrup mat, respectively.

39. The method of claim 26 which includes making each said hook narrower at its entrance than the wire strand which it hooks over whereby a snap fit is achieved between said hook and said wire strand.

40. The method of claim 39 in which said entrance of said hook is provided with at least one rounded cam surface whereby said wire strand snaps easily into said hook.

41. The method of claim 40 wherein said entrance to said hook is provided with two of said rounded cam surfaces, one on either side of said entrance to said hook.

42. The method of claim 41 in which said tail hook is provided with an entrance narrower than the circumferential strand which it hooks over whereby a snap fit therebetween is effected.

43. The method of claim 28 in which said tail hook is provided with an entrance narrower than the circumferential strand which it hooks over whereby a snap fit therebetween is effected.

44. The method of claim 26, 27 or 28 which includes slidably joining each of said links to said tie rod whereby said links can be slid along the length of said tie rod until properly located for hooking over a longitudinal strand of either said cage or said stirrup mat, respectively.

* * * * *